US010603535B2

(12) United States Patent
Alexander et al.

(10) Patent No.: US 10,603,535 B2
(45) Date of Patent: Mar. 31, 2020

(54) EXERCISE MACHINE WITH A FORCE TRANSDUCER

(71) Applicant: ARX Fit, LLC, Austin, TX (US)

(72) Inventors: Mark Alexander, Austin, TX (US); Jay Beaudry, Austin, TX (US)

(73) Assignee: ARX FIT, INC., Austin, TX (US)

( * ) Notice: Subject to any disclaimer, the term of this patent is extended or adjusted under 35 U.S.C. 154(b) by 129 days.

(21) Appl. No.: 15/829,183

(22) Filed: Dec. 1, 2017

(65) Prior Publication Data

US 2019/0168052 A1 Jun. 6, 2019

(51) Int. Cl.

| | |
|---|---|
| ***A63B 21/005*** | (2006.01) |
| ***A63B 24/00*** | (2006.01) |
| ***A63B 71/06*** | (2006.01) |
| ***A63B 21/22*** | (2006.01) |
| ***A63B 21/00*** | (2006.01) |
| ***A63B 23/04*** | (2006.01) |

(52) U.S. Cl.

CPC ..... *A63B 21/0058* (2013.01); *A63B 21/153* (2013.01); *A63B 21/22* (2013.01); *A63B 21/4034* (2015.10); *A63B 21/4043* (2015.10); *A63B 23/0417* (2013.01); *A63B 24/0062* (2013.01); *A63B 24/0075* (2013.01); *A63B 24/0087* (2013.01); *A63B 71/0622* (2013.01); *A63B 21/4035* (2015.10); *A63B 2024/0093* (2013.01); *A63B 2220/54* (2013.01); *A63B 2225/50* (2013.01)

(58) Field of Classification Search

CPC ..... A63B 21/0058; A63B 24/0087; A63B 21/153; A63B 21/22; A63B 71/0622; A63B 24/0062; A63B 24/0075; A63B 2225/50; A63B 2220/54; A63B 2024/0093

See application file for complete search history.

(56) References Cited

U.S. PATENT DOCUMENTS

| | | | | |
|---|---|---|---|---|
| 6,280,361 | B1 | 8/2001 | Harvey et al. | |
| 8,105,206 | B2 | 1/2012 | Rindfleisch | |
| 8,388,499 | B1 | 3/2013 | Rindfleisch | |
| 8,475,338 | B2 | 7/2013 | Greenhill et al. | |
| 2010/0298104 | A1 | 11/2010 | Turner | |
| 2012/0231929 | A1* | 9/2012 | Hsieh | A63B 21/0058 482/5 |
| 2014/0194250 | A1 | 7/2014 | Reich et al. | |
| 2017/0282015 | A1* | 10/2017 | Wicks | G05G 9/047 |
| 2018/0326241 | A1 | 11/2018 | Huskins et al. | |

OTHER PUBLICATIONS

International Search Report for PCT Application No. PCT/US2018/063388 dated Mar. 22, 2019.

* cited by examiner

*Primary Examiner* — Sundhara M Ganesan
(74) *Attorney, Agent, or Firm* — K&L Gates LLP

(57) ABSTRACT

Systems, methods, and devices for measuring force applied to a machine, where an exercise machine comprises a frame; a motor assembly; a mounting plate, wherein the mounting plate is attached to the motor assembly; a force transducer. The force transducer is attached to the mounting plate and the frame and is the only point of contact between the frame and the motor assembly. The force transducer is configured to measure force applied to the motor assembly.

19 Claims, 8 Drawing Sheets

EXERCISE MACHINE WITH A FORCE TRANSDUCER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Traditional resistance exercise equipment, such as, for example, barbells and dumbbells may rely on gravity to produce force. There may be inherent risks and inefficiencies with such traditional systems. Attempts may have been made to use other types of resistance exercise machines other than traditional weights, such as, for example, pneumatics and motors. However, these devices may not be effective for meeting the specific needs of a user. That is, there may be a need for improved techniques for providing exercises that take into account static, concentric, and eccentric muscular contractions.

SUMMARY

In an embodiment, an exercise machine comprises a frame; a motor assembly; a mounting plate, wherein the mounting plate is attached to the motor assembly, and a force transducer. The force transducer is attached to the mounting plate and the frame and configured to measure force applied to the motor assembly. In various embodiments, the force transducer is the only point of contact between the frame and the motor assembly.

In an embodiment, an exercise method comprises applying force to a motor assembly, wherein a force transducer is the only point of contact between a frame of an exercise machine and the motor assembly; and measuring force applied to the motor assembly with the force transducer.

In an embodiment, a system comprises a motor; a gearbox, wherein the gearbox is coupled to the motor; a rotating flange coupled to the gearbox; a mounting plate coupled to the gearbox, the motor, or both the gearbox and the motor; a force transducer coupled to the mounting plate and a frame of a machine. In various embodiments, the only point of contact between the frame and the motor, the gearbox, or both the gearbox and the motor, is the force transducer, wherein the force transducer is configured to measure force applied to the motor, the gearbox, or both the gearbox and the motor.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
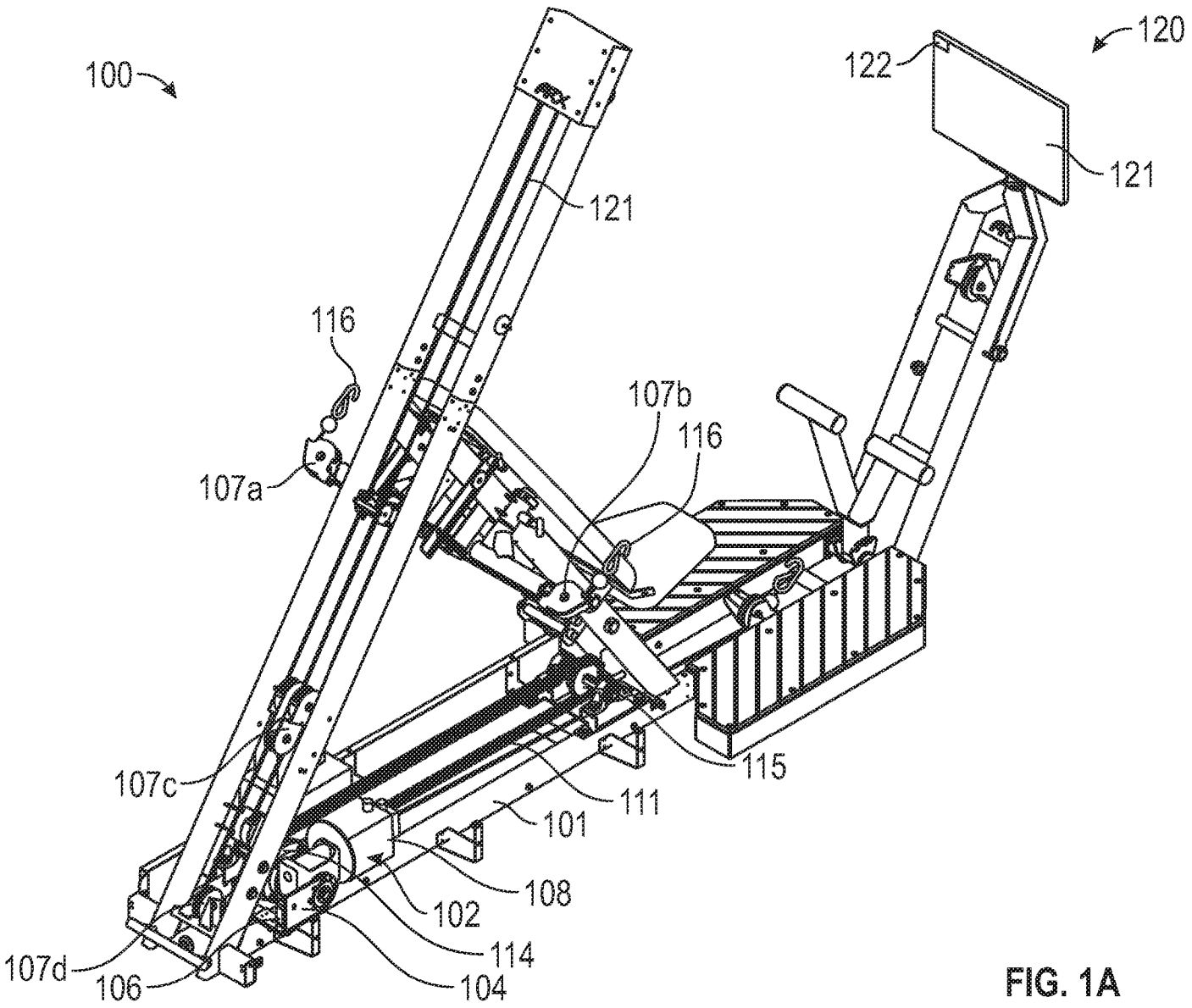
FIG. 1A illustrates an exercise machine with a force transducer in accordance with embodiments of the present disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Systems, methods, and devices of the present disclosure may adapt to a user's capabilities instead of using a linear, constant, and gravitational force. Embodiments of the present disclosure may utilize specific programs and commands from a software application to control a motor assembly and biometric measuring and/or tracking system. Embodiments of the present disclosure may allow resistance exercises to be perfectly matched to the user's needs and may be quantified in a more robust manner than previously.

Embodiments of the present disclosure are designed to safely, effectively, and efficiently produce exercise prescriptions for users by utilizing computer-controlled motorized resistance. Embodiments of the present disclosure utilize a biometric measurement and tracking system unique to the marketplace. Embodiments of the present disclosure utilize measurement devices (e.g., a force transducer/load cell), communication from devices to the software application, and specific programming of the software application to communicate back to a motor and the device.

Embodiments of the present disclosure may allow resistance (e.g., mechanical resistance/force) exercises which can be precisely programmed and prescribed, directed from a computer software program without the need for a supervisor or practitioner, and biometric data may be saved in a cloud-based system.

Figure 1B:
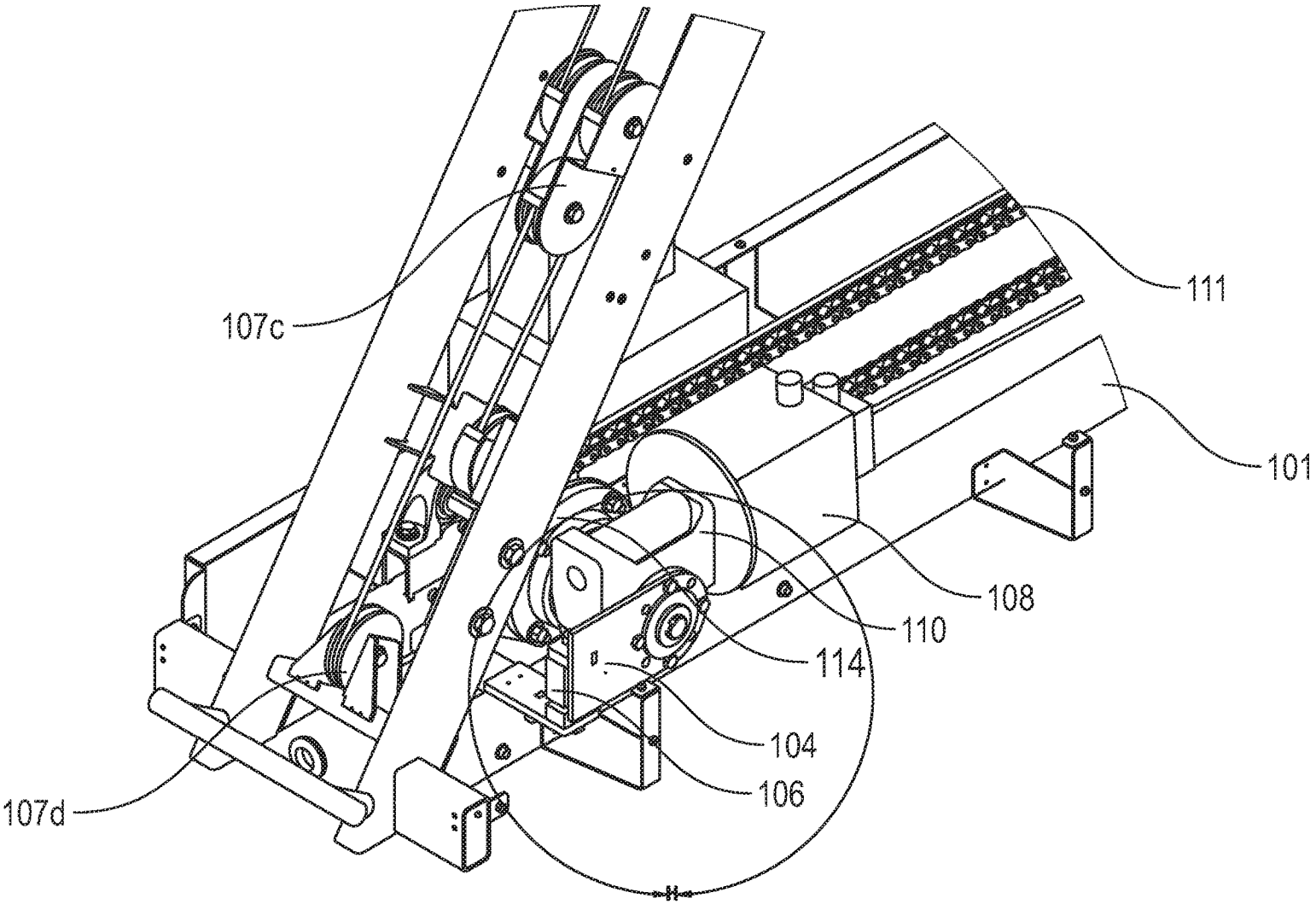
FIG. 1B illustrates a close-up perspective view of the exercise machine shown in FIG. 1A in accordance with various embodiments.
Figure 1C:
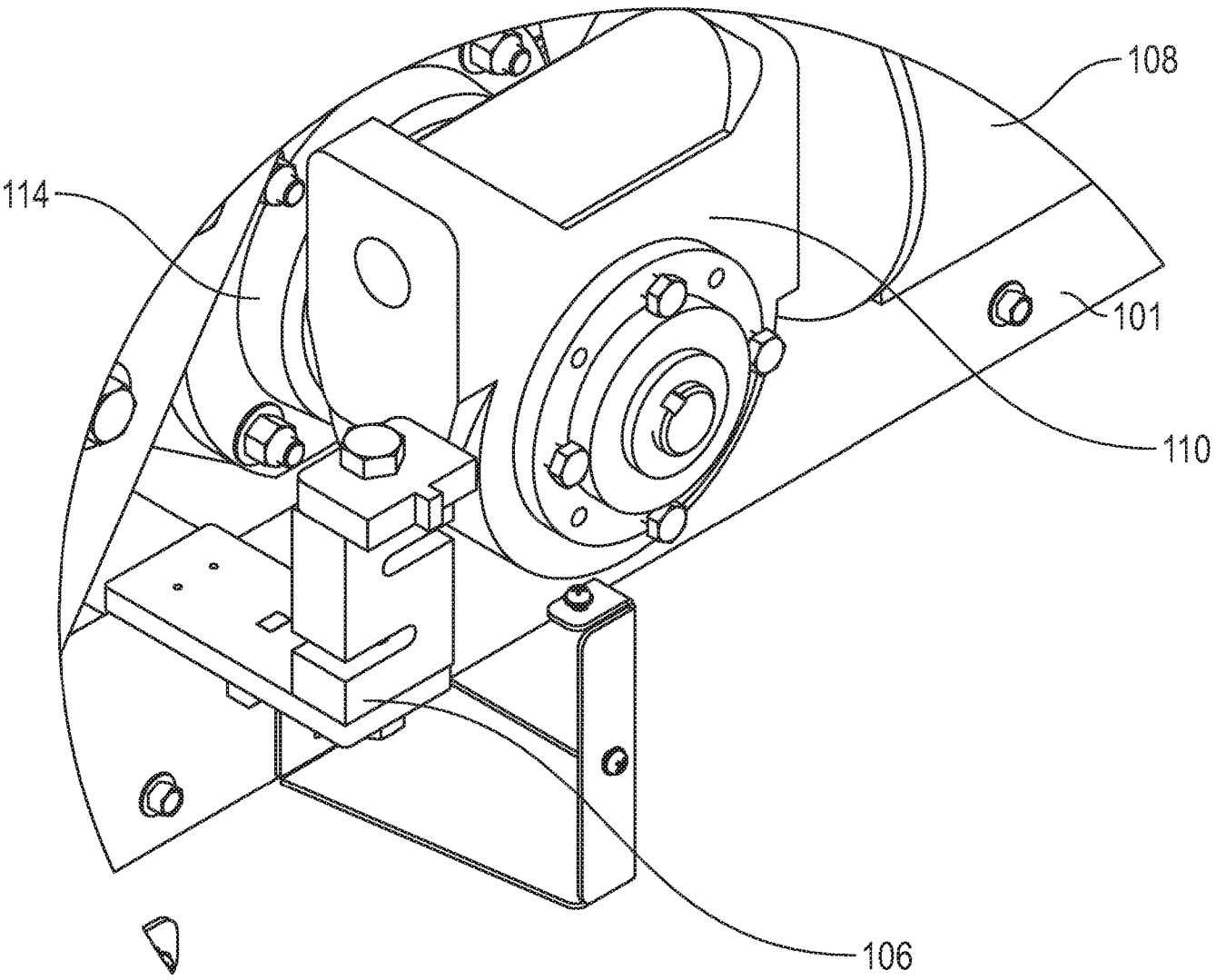
FIG. 1C illustrates a close-up perspective view of the force transducer mounted in the exercise machine shown in FIG. 1A with a mounting plate removed in accordance with various embodiments.

FIGS. 1A-1C illustrate an exercise machine 100 including frame 101, motor assembly 102, mounting plate 104, force transducer 106, spool assemblies 107*a*, 107*b*, 107*c*, 107*d*, chain 111, cable 112, rotating flange 114 (also shown on FIG. 2), and sprocket 115. In some embodiments, exercise machine 100 may include an information handling system 120 (e.g., a cloud based server, portable electronic devices, computers, and the like). In certain embodiments, information handling system 120 may include display 121 and system transceiver 122. Motor assembly 102 may include motor 108 and gearbox 110 (i.e., gearbox 110 may be coupled to motor 108). Spool assemblies 107*a*-107*d* may be positioned/coupled (e.g., welds, bolts, screws, or any suitable means) on and throughout exercise machine 100. Each of the spool assemblies described above may include a cable 112. Spool assembly 107*d* may be coupled to rotating flange 114 (e.g., welds, screws, bolts, bearings), thereby rotating/turning rotating flange 114 as a user pulls cable 112. Rotating flange 114 may be coupled to gearbox 110 (e.g., coupled (e.g., weld, screws, bolts, bearings) to at least one gear and/or sprocket within gearbox 110). Cable 112 may also be coupled (e.g., looped around the clip and crimped) to at least one clip 116 (e.g., a carabiner for attaching a handle for a user).

Mounting plate 104 may be directly coupled to motor assembly 102 (as shown on FIGS. 1A-1B and FIG. 2) and force transducer 106 (i.e., mounting plate 104 may be positioned between force transducer 106 and motor assembly 102). FIG. 1C illustrates a close-up view of the motor assembly 102 and the force transducer 106 with the mounting plate 104 removed. Force transducer 106 may be coupled directly to frame 101. Force transducer 106 may be positioned between frame 101 and mounting plate 104/motor assembly 102. Force transducer 106 may directly contact mounting plate 104 and frame 101. Mounting plate 104 may be coupled (e.g., welds, screws, bolts) to gearbox 110, motor 108, or both. Force transducer 106 may be the only coupling (i.e., only point of contact between frame 101 and mounting plate 104/motor assembly 102) on frame 101 that couples frame 101 to mounting plate 104/motor assembly 102. Gearbox 110 may include at least one gear and/or sprocket (i.e., the gears/sprockets within gearbox 110 may be of different diameters to allow for different resistances for a user as a user pulls cable 112) coupled to linkage 111 (e.g., chain). Linkage 111 may be coupled to sprocket 113 (e.g., sprocket 113 may be about 1 foot to about 3 feet from motor assembly 102).

In various embodiments, force transducer 106 is the only force transducer/load cell on frame 101 (or exercise machine 100), and may be configured to measure force applied to frame 101 as a user pulls cable 112. As a user pulls cable 112, all of the spool assemblies including spool assembly 107*d*, rotating flange 114, linkage 111, sprocket 113, and motor assembly 102 all may rotate, thereby providing resistance to the user via cable 112. Motor assembly 102 may be programmed to provide various resistances based on a user's needs/prescription. That is, exercise machine 100 may be a motor driven device with adaptive resistance (e.g., speed of motor may vary along with utilizing different gears within gearbox 110 to provide varying resistance to a user) with a calculated force that is dynamic and responsive to a user. As a user pulls cable 112, frame 101 may act as (or may be) a torque arm, and force transducer 106 may indirectly measure the pull force (or push force) by measuring the torque applied to motor assembly 102.

Figure 2:
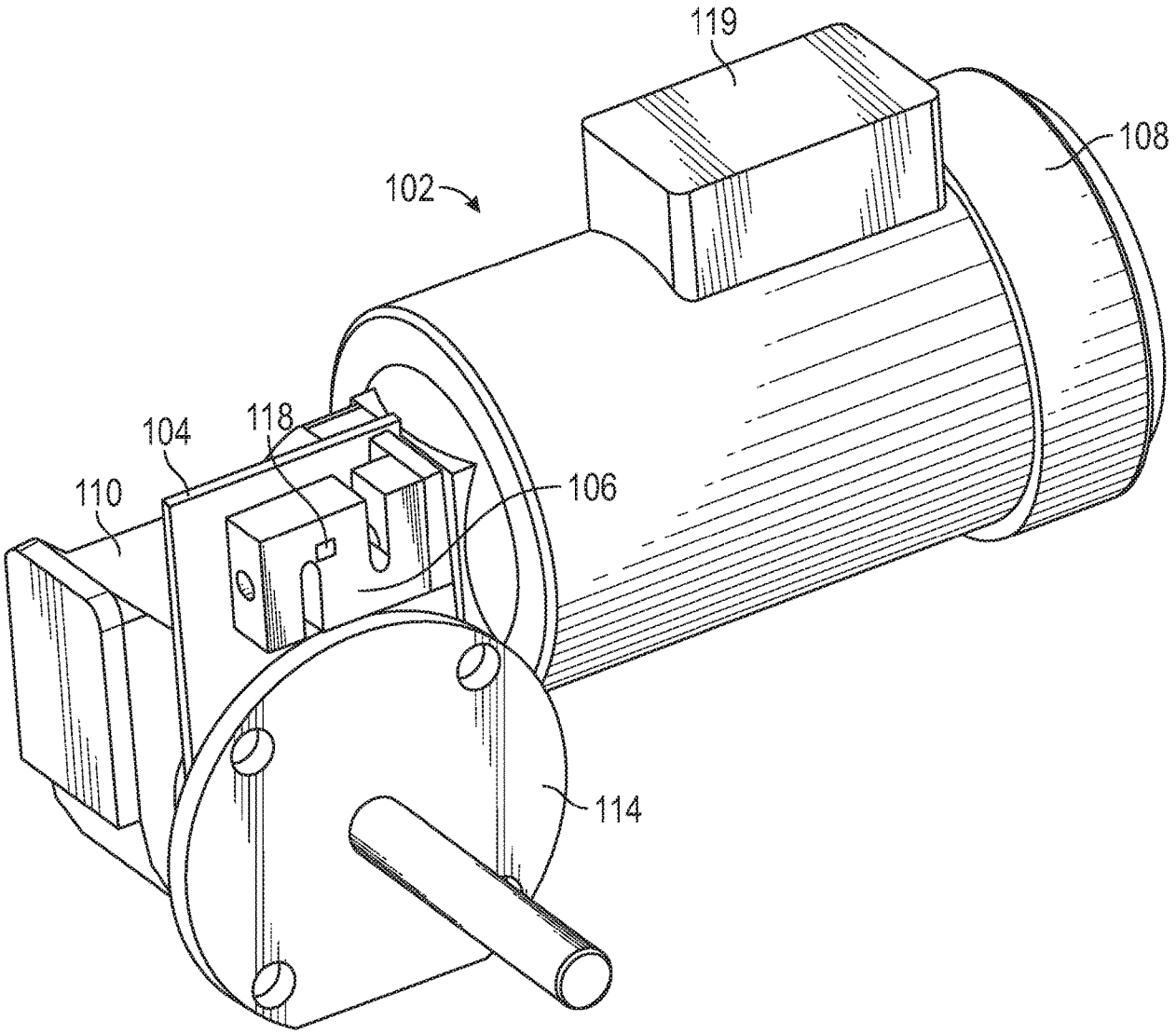
FIG. 2 illustrates a system for measuring force in accordance with embodiments of the present disclosure.

As noted above, exercise machine 100 may also include a rotating flange 114 (as shown on FIGS. 1A-1B and FIG. 2). Rotating flange 114 may allow motor assembly 102 to freely rotate, thus the force applied to motor assembly 102 by a user during a workout session can accurately represent the force produced by the user. Rotating flange 114 is implemented because if a fixed flange were to be utilized, then the flange would absorb the torque force(s) and be unable to accurately measure forces. Rotating flange 114 may be mounted (e.g., bearing mounted) to gearbox 110 and/or motor 108. Rotating flange 114 may allow for a low coefficient of friction and low inertia which may allow for accuracy of any force measurement taken/measured by force transducer 106. The positioning of force transducer 106 may allow for measurements of push and/or pull forces. The force applied by the user at various locations and positions of the exercise machine 100 can all be measured by the force transducer 106 coupled to the motor assembly 102.

As shown on FIG. 2, force transducer 106 may be an s-curve force transducer/load cell, and may include (or be coupled to) a first transceiver 118 for wireless communications (e.g., transmitting data such as force measurements). This data may be transmitted to an information handling system (e.g., information handling system 120, shown on FIG. 1A). Information handling system 120 may display (e.g., display 121) force measurements that it receives via system transceiver 122. A user may view this force measurement data and maintain or modify his/her workout routine as desired and/or prescribed. Motor assembly 102 may include a second transceiver 119 for receiving programming instructions regarding resistance. That is, motor assembly 102 may adjust mechanical resistance (e.g., via different gears and motor speed) it provides (to a user) based on instructions it receives wirelessly (or wired in some embodiments) from an information handling system (e.g., external device separate from the exercise machine or an internal device that is a part of the exercise machine).

FIGS. 3A-3E illustrate another example of an exercise machine (e.g., exercise machine 124) in accordance with various embodiments. Exercise machine 124 may include frame 101, motor assembly 102, mounting plate 104, force transducer 106, rotating flange 114 (also shown on FIG. 2), moveable portion 126 which may include track 128 that contacts rotating flange 114. Motor assembly 102 may comprise motor 108 and gearbox 110.

Figure 3A:
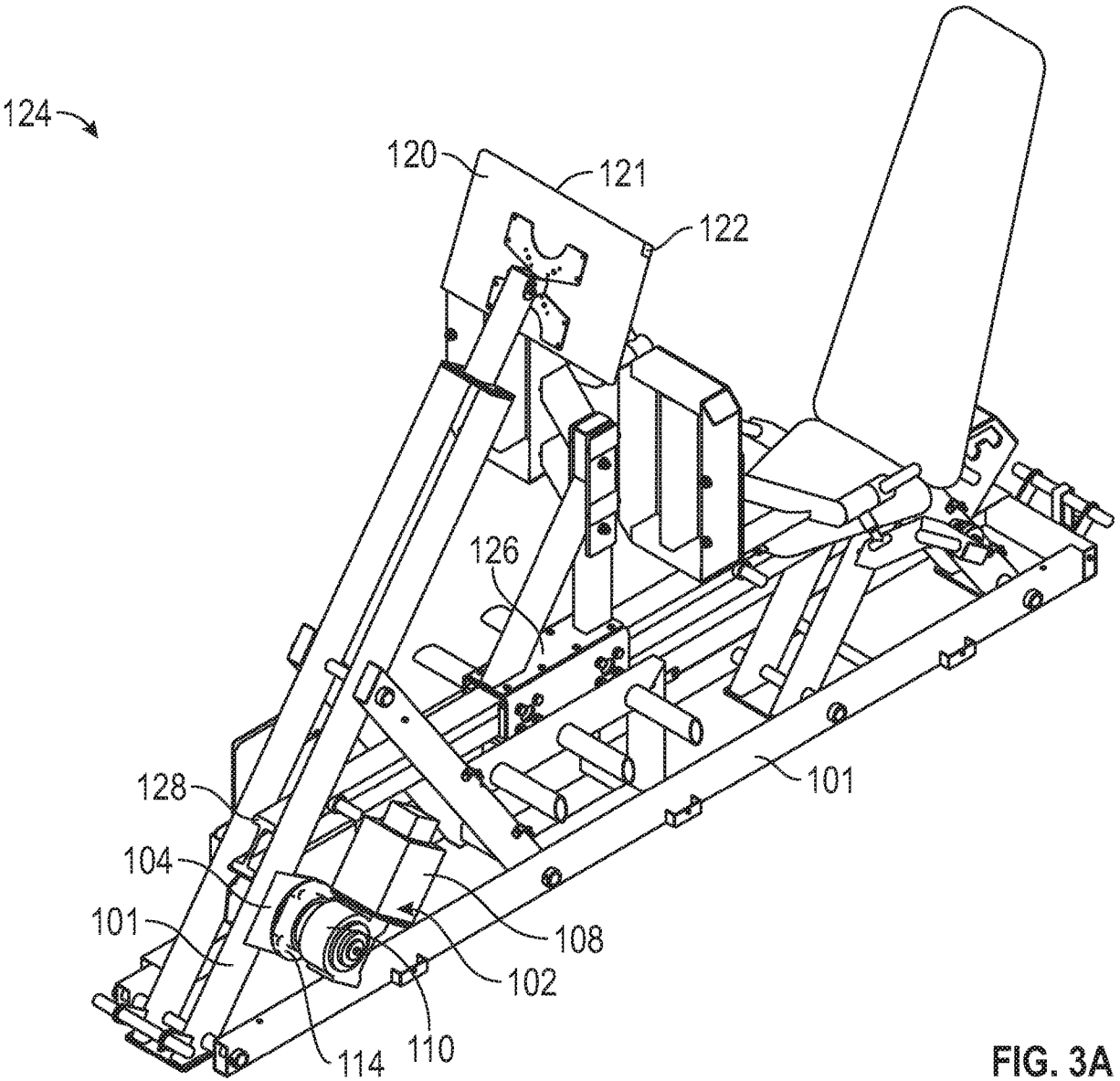
FIG. 3A illustrates an exercise machine with a force transducer in accordance with embodiments of the present disclosure.
Figure 3B:
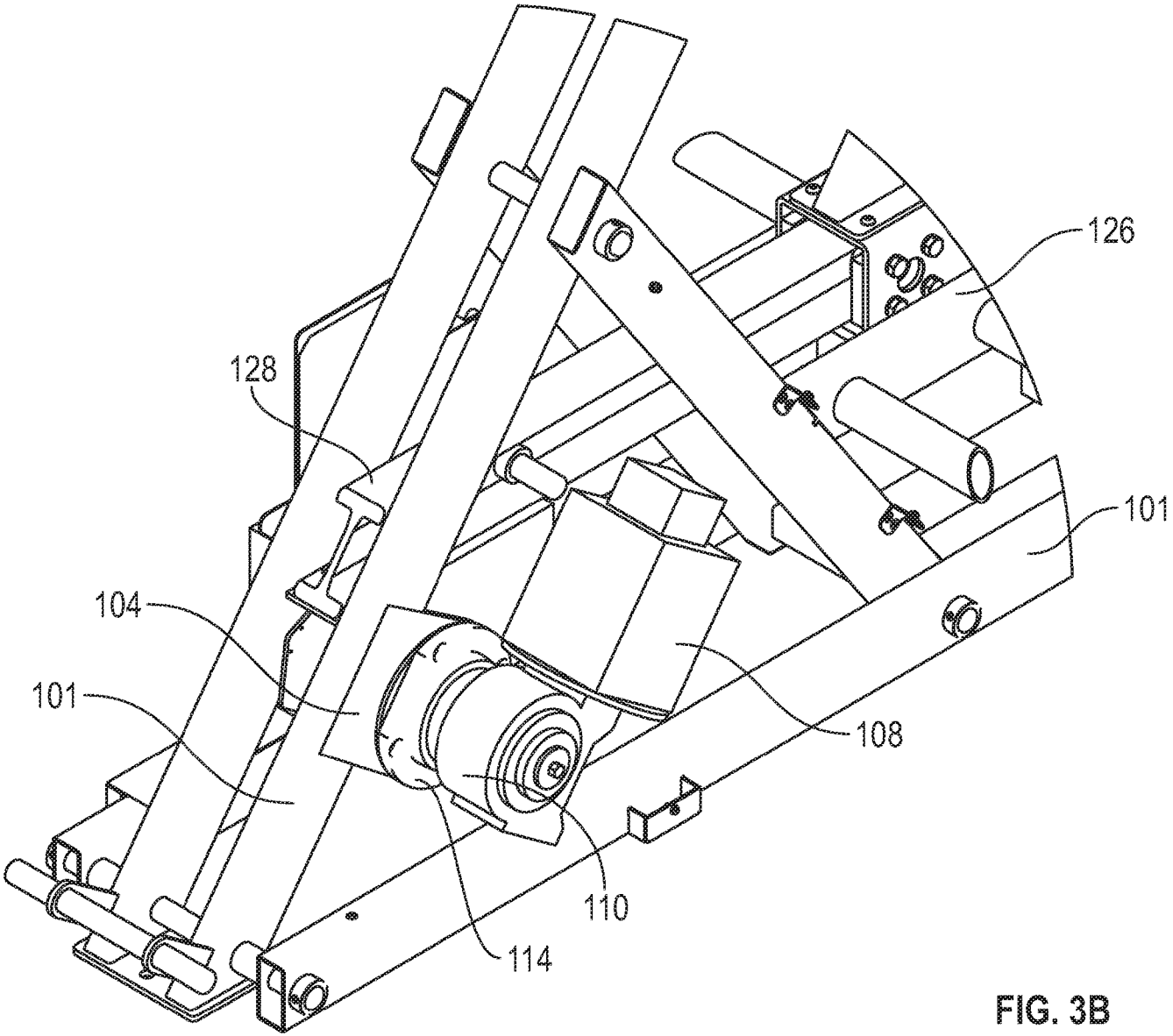
FIGS. 3B-3D illustrate close-up perspective views of the exercise machine shown in FIG. 3A in accordance with various embodiments.
Figure 3C:
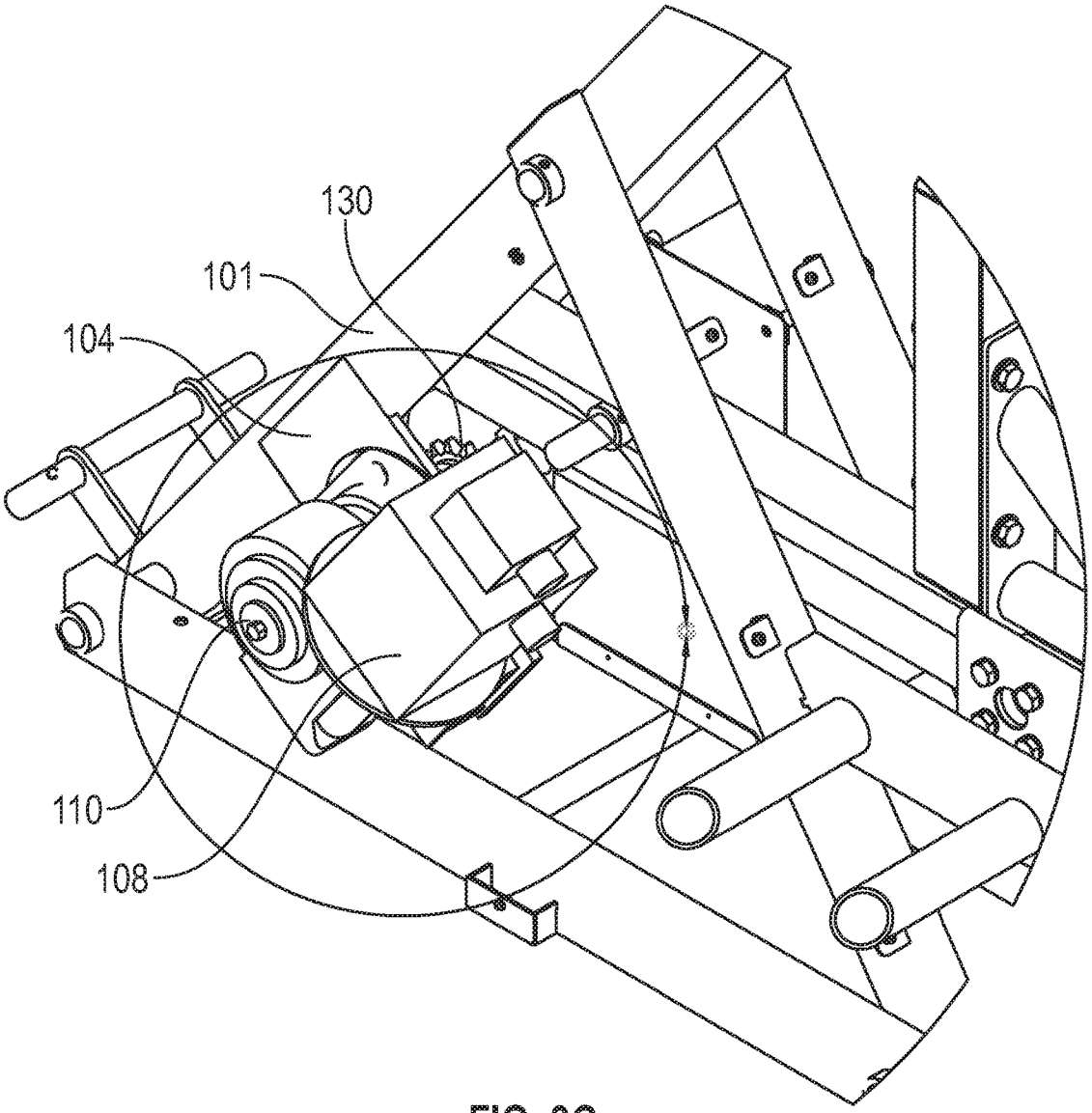
Figure 3E:
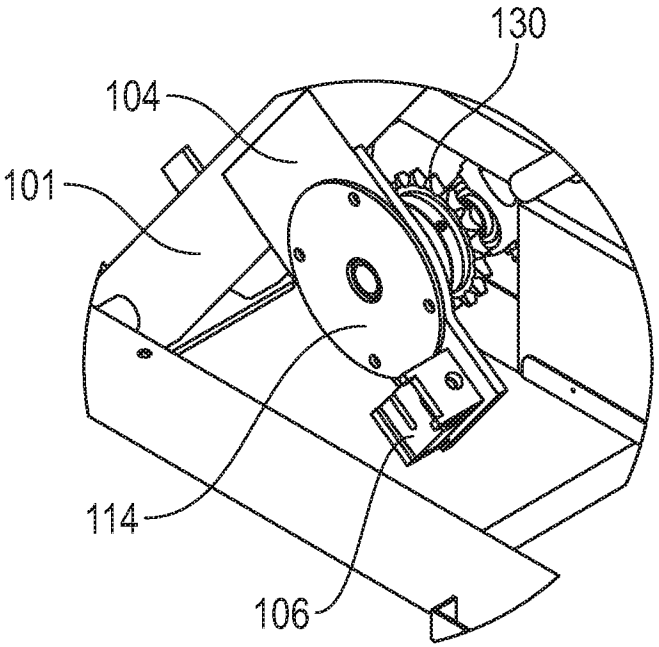
FIG. 3E illustrates a close-up perspective view of the force transducer mounted in the exercise machine shown in FIG. 3A with a motor assembly removed in accordance with various embodiments.
Figure 3D:
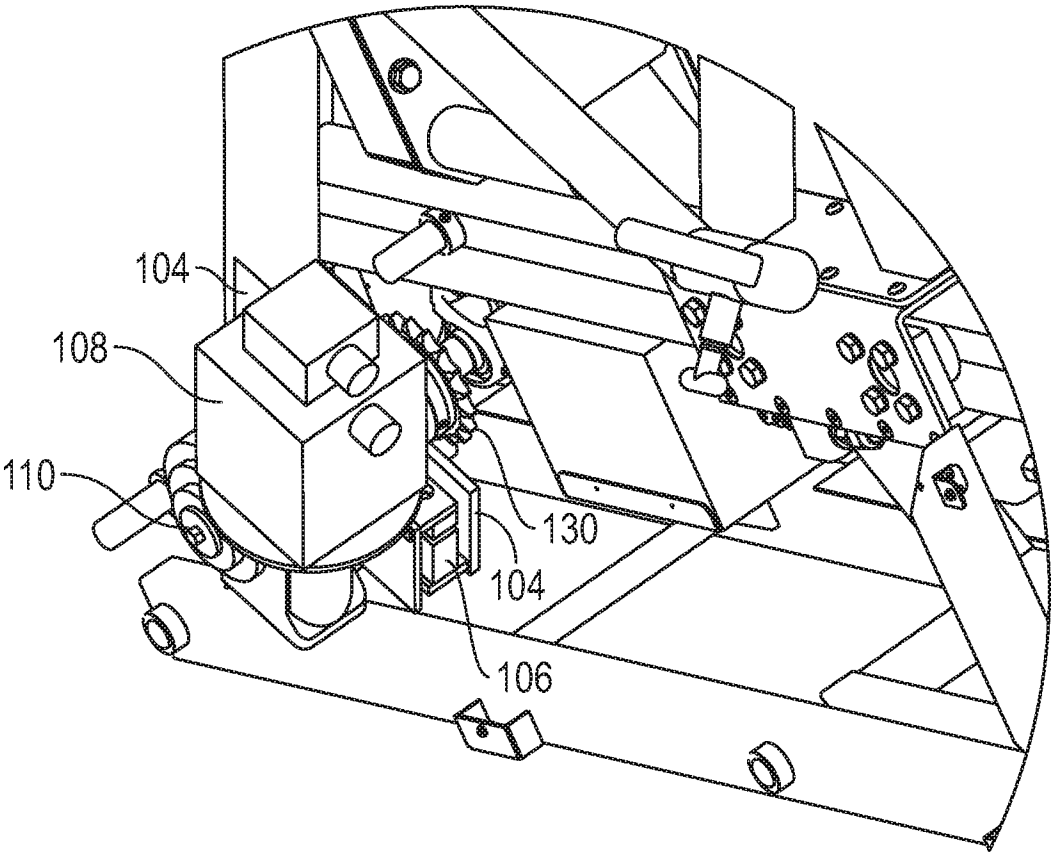

FIG. 3E illustrates a close-up view of the mounting plate 104 and the force transducer 106 with the motor assembly 102 removed. Mounting plate 104 may be coupled to frame 101. Force transducer 106 may be coupled to mounting plate 104 and motor assembly 102 (i.e., force transducer 106 may be positioned between mounting plate 104/frame 101 and motor assembly 102). Force transducer 106 may be coupled (e.g., welds, screws, bolts) to gearbox 110, motor 108, or both. Force transducer 106 may be the only coupling (i.e., only point of contact between mounting plate 104/frame 101 and motor assembly 102) on frame 101 that couples mounting plate 104/frame 101 to motor assembly 102. Gearbox 110 may include at least one gear and/or sprocket (i.e., the gears/sprockets within gearbox 110 may be of different diameters to allow for different resistances for a user as a user moves moveable portion 126) coupled (e.g., via a shaft) to rotating flange 114. In some embodiments, rotating flange 114 may include teeth 130. As a user moves moveable portion 126 (e.g., push or pull) back or forth, moveable portion 126 moves along rotating flange 114 via track 128. As discussed above, resistance to movement of moveable portion 126 may be controlled/programmed with motor assembly 102.

In various embodiments, force transducer 106 is the only force transducer/load cell on frame 101 (or exercise machine 100), and may be configured to measure force applied to frame 101 as a user pulls/pushes moveable portion 126. As a user moves moveable portion 126, the motor assembly 102 provides a calculated resistance force via the shaft. The rotating flange 114 turns/rotates such that there is little to no torque produced between the motor assembly 102 and the shaft. Instead, mounting plate 104 and force transducer 106 attach motor assembly 102 to frame 101, thereby causing torque forces to the generated at the attachment point and measured by force transducer 106. Motor assembly 102 may be programmed to provide various resistances based on a user's needs/prescription. That is, exercise machine 124 may be a motor driven device with adaptive resistance with a calculated force that is dynamic and responsive to a user. As a user pulls/pushes moveable portion 126, frame 101 may act as (or may be) a torque arm, and force transducer 106 may indirectly measure the pull force (or push force) by measuring the torque applied to motor assembly 102.

In some embodiments, exercise machine 124 may include an information handling system 120 (e.g., a cloud based server, portable electronic devices, computers, and the like), as described above. In certain embodiments, information handling system 120 may include display 121. Operation of force transducer 106 has been set forth above. That is, as a user pushes or pulls moveable portion 126, force transducer measures the torque applied to motor assembly 102. As discussed above, force measurements may be transmitted to information handling system via transceiver 122. Information handling system 120 may display (e.g., display 121) force measurements that it receives via system transceiver 122. A user may view this force measurement data and maintain or modify his/her workout routine as desired and/or prescribed.

As set forth above, systems, devices, and methods of the present disclosure may be implemented by an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory ("RAM"), one or more processing resources such as a central processing unit ("CPU") or hardware or software control logic, read-only memory ("ROM"), and/or other types of nonvolatile memory. Additional components of the information handling system may include one or more disk drives, one or more network ports for communication with external devices as well as various input and output (I/O) devices, such as a keyboard, a mouse, and a video display. The information handling system also may include one or more buses operable to transmit communications between the various hardware components.

The information handling system may also include computer-readable media. Computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk (CD), CD-ROM, RAM, ROM, electrically erasable programmable read-only memory ("EEPROM"), and/or flash memory; as well as communications media such wires, optical fibers, microwaves, radio waves, and other electromagnetic and/or optical carriers; and/or any combination of the foregoing.

Having described various devices and methods herein, exemplary embodiments or aspects can include, but are not limited to:

In a first embodiment, an exercise machine comprises a frame; a motor assembly; a mounting plate, wherein the mounting plate is attached to the motor assembly; a force transducer, wherein the force transducer is attached to the mounting plate and the frame; wherein the force transducer is the only point of contact between the frame and the motor assembly; wherein the force transducer is configured to measure force applied to the motor assembly.

A second embodiment can include the exercise machine of the first embodiment, further comprising a transceiver configured to transmit measured force information.

A third embodiment can include the exercise machine of the first or second embodiments, wherein the motor assembly comprises a gearbox and a motor.

A fourth embodiment can include the exercise machine of any of the first through third embodiments, wherein the motor assembly is programmed to provide mechanical resistance.

A fifth embodiment can include the exercise machine of any of the first through fourth embodiments, wherein the force transducer is an s-curve force transducer.

A sixth embodiment can include the exercise machine of any of the first through fifth embodiments, further comprising a display configured to display the measured force information.

A seventh embodiment can include the exercise machine of any of the first through sixth embodiments, further comprising a rotating flange, wherein the rotating flange is coupled to the motor assembly.

An eighth embodiment can include the exercise machine of any of the first through seventh embodiments, wherein the transceiver is configured to transmit measured force information to cloud storage.

A ninth embodiment can include the exercise machine of any of the first through eighth embodiments, wherein the force transducer is configured to measure torque applied to the motor assembly.

A tenth embodiment can include the exercise machine of any of the first through ninth embodiments, wherein the motor assembly comprises a transceiver configured to receive instructions on an amount of mechanical resistance to provide.

In an eleventh embodiment, an exercise method comprises applying force to a motor assembly, wherein a force transducer is the only point of contact between a frame of an exercise machine and the motor assembly; and measuring the force applied to the motor assembly with the force transducer.

A twelfth embodiment can include the exercise method of the eleventh embodiment, further comprising transmitting measured force information with a transceiver that is attached to the force transducer.

A thirteenth embodiment can include the exercise method of any of the eleventh or twelfth embodiments, further comprising measuring torque applied to the motor assembly with the force transducer.

A fourteenth embodiment can include the exercise method of any of the eleventh through thirteenth embodiments, further comprising measuring torque applied to the motor assembly with the force transducer.

A fifteenth embodiment can include the exercise method of any of the eleventh through fourteenth embodiments, further comprising transmitting measured force information to cloud storage.

A sixteenth embodiment can include the exercise method of any of the eleventh through fifteenth embodiments, further comprising receiving instructions, with the motor assembly, regarding an amount of mechanical resistance to provide with the motor assembly.

In a seventeenth embodiment, a system comprises a motor; a gearbox, wherein the gearbox is coupled to the motor; a rotating flange coupled to the gearbox; a mounting plate coupled to the gearbox, the motor, or both the gearbox and the motor; a force transducer coupled to the mounting plate and a frame of a machine, wherein the only point of contact between the frame and the motor, the gearbox, or both the gearbox and the motor, is the force transducer, wherein the force transducer is configured to measure force applied to the motor, the gearbox, or both the gearbox and the motor.

An eighteenth embodiment can include the system of the seventeenth embodiment, further comprising a transceiver configured to transmit measured force information.

A nineteenth embodiment can include the system of any of the seventeenth through eighteenth embodiments, further comprising a transceiver configured to receive instructions on an amount of mechanical resistance (e.g., force) to provide with the motor, the gearbox, or both the gearbox and the motor.

A twentieth embodiment can include the system of any of the seventeenth through nineteenth embodiments, wherein the force transducer is an s-curve force transducer.

In a twenty-first embodiment, an exercise machine comprises a frame; a mounting plate, wherein the mounting plate is attached to the frame; a force transducer, wherein the force transducer is attached to the mounting plate; a motor assembly, wherein the motor assembly is attached to the force transducer; wherein the force transducer is the only point of contact between the frame and the motor assembly; wherein the force transducer is configured to measure force applied to the motor assembly.

In a twenty-second embodiment, a system comprises a motor; a gearbox, wherein the gearbox is coupled to the motor; a rotating flange coupled to the gearbox; a force transducer coupled to the gearbox, the motor, or both the gearbox and the motor; a mounting plate coupled to the force transducer, wherein the mounting plate is coupled to a frame of a machine, wherein the only point of contact between the frame and the motor, the gearbox, or both the gearbox and the motor, is the force transducer, wherein the force transducer is configured to measure force applied to the motor, the gearbox, or both the gearbox and the motor.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An exercise machine comprising:

a frame;

a motor assembly;

a mounting plate, wherein the mounting plate is attached to the motor assembly; and a force transducer, wherein the force transducer is attached to the mounting plate and the frame, wherein the force transducer is the only point of contact between the frame and the motor assembly, and wherein the force transducer is configured to measure torque applied to the motor assembly.

2. The exercise machine of claim 1, further comprising a transceiver configured to transmit measured force information.

3. The exercise machine of claim 2, wherein the motor assembly comprises a gearbox and a motor.

4. The exercise machine of claim 3, wherein the motor assembly is programmed to provide mechanical resistance.

5. The exercise machine of claim 4, wherein the force transducer is an s-curve force transducer.

6. The exercise machine of claim 5, further comprising a display configured to display the measured force information.

7. The exercise machine of claim 6, further comprising a rotating flange, wherein the rotating flange is coupled to the motor assembly.

8. The exercise machine of claim 7, wherein the transceiver is configured to transmit measured force information to cloud storage.

9. The exercise machine of claim 8, wherein the motor assembly comprises a transceiver configured to receive instructions on an amount of mechanical resistance to provide.

10. An exercise method comprising:

applying force to a motor assembly, wherein a force transducer is the only point of contact between a frame of an exercise machine and the motor assembly; and measuring the force applied to the motor assembly with the force transducer.

11. The exercise method of claim 10, further comprising transmitting measured force information with a transceiver that is attached to the force transducer.

12. The exercise method of claim 11, further comprising displaying measured force information on a display.

13. The exercise method of claim 12, further comprising measuring torque applied to the motor assembly with the force transducer.

14. The exercise method of claim 13, further comprising transmitting measured force information to cloud storage.

15. The exercise method of claim 14, further comprising receiving instructions, with the motor assembly, regarding an amount of mechanical resistance to provide with the motor assembly.

16. A system comprising:

a motor;

a gearbox, wherein the gearbox is coupled to the motor;

a rotating flange coupled to the gearbox;

a mounting plate coupled to the gearbox, the motor, or both the gearbox and the motor; and a force transducer coupled to the mounting plate and a frame of a machine, wherein the only point of contact between the frame and the motor, the gearbox, or both the gearbox and the motor, is the force transducer, and wherein the force transducer is configured to measure torque applied to the motor, the gearbox, or both the gearbox and the motor.

17. The system of claim 16, further comprising a transceiver configured to transmit measured force information.

18. The system of claim 16, further comprising a transceiver configured to receive instructions on an amount of mechanical resistance to provide with the motor, the gearbox, or both the gearbox and the motor.

19. The system of claim 16, wherein the force transducer is an s-curve force transducer.

* * * * *